United States Patent [19]

Sullivan

[11] 4,425,202

[45] Jan. 10, 1984

[54] METHOD OF MAKING AND COLOR STABILIZATION OF CHOLINE BASE

[75] Inventor: Edward A. Sullivan, Beverly, Mass.

[73] Assignee: Thiokol Corporation, Chicago, Ill.

[21] Appl. No.: 409,194

[22] Filed: Aug. 18, 1982

[51] Int. Cl.[3] ..... C25B 3/00

[52] U.S. Cl. ..... 204/72

[58] Field of Search ..... 204/72

[56] References Cited

U.S. PATENT DOCUMENTS

| | | | |
|---|---|---|---|
| 2,363,387 | 11/1944 | Bock | 204/72 |
| 2,737,486 | 3/1956 | Bodamer | 204/72 |
| 3,402,115 | 9/1968 | Campbell | 204/72 |
| 3,523,068 | 8/1978 | Eisenhauer | 204/72 |
| 4,294,911 | 10/1981 | Guild | 430/302 X |

*Primary Examiner*—John F. Niebling

*Attorney, Agent, or Firm*—Gerald K. White

[57] ABSTRACT

Choline base is prepared by the electrolysis of choline chloride in electrolytic cells having the anode and cathode separated by a cation exchange membrane. Color stabilization of choline base is effected through concentration control and/or the addition of a sulfite prior to electrolytic manufacture of the choline base.

11 Claims, 1 Drawing Figure

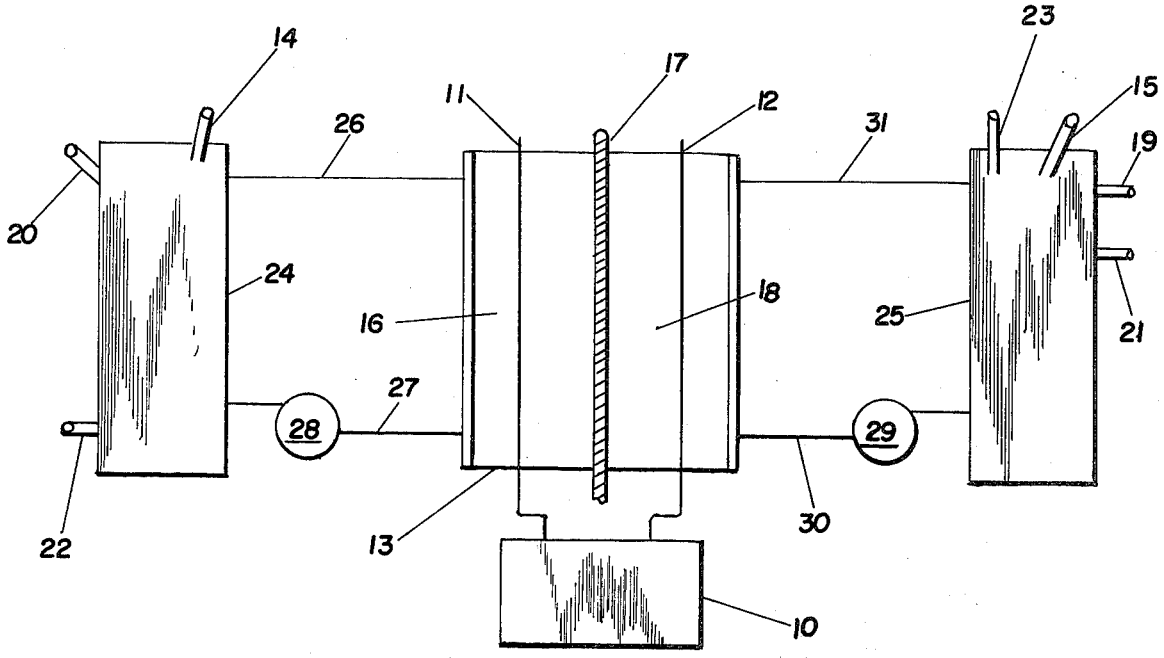
14
26
11
17
12
31
23
15
19
20
24
16
18
25
21
27
28
29
22
13
30
10

METHOD OF MAKING AND COLOR STABILIZATION OF CHOLINE BASE

BACKGROUND OF THE INVENTION

Choline base (β-hydroxyethyl trimethylammonium hydroxide) is a well-known organic base suitable for a variety of uses. For example, aqueous solutions of choline base are useful in connection with electronic applications such as positive photoresist developing agents, as anisotropic etching agents, and as washing agents for silicon wafers. Use in the electronics area requires that there be no residue following the normal post bake period because even traces of impurities such as alkali metals would interfere in the operation of the electronic circuits. Accordingly, impurity specifications for choline base to be used in the electronics industry are very strict. Typically such specifications are, based upon contained choline base, ≦10000 ppm Cl, Br, I, or carbonate and ≦15 ppm each of Li, Na, and K. It is understood, however, that it is advantageous to the electronics fabricator to employ choline base in which the above mentioned impurities approach zero.

Choline base has been produced by various techniques in the past such as illustrated in U.S. Pat. No. 2,774,759. In addition it is known to manufacture quaternary ammonium hydroxides by use of electrochemical processes. Typical U.S. Pat. Nos. involving such processes include 2,363,386; 2,363,387; 3,402,115; and 3,523,068. However, none of these patents specifically mention choline base. It is also known that sulfite stabilizing agents are useful to retard color darkening when added to developing solutions such as trialkylmonoalkanolammonium hydroxide. This function of sulfites is illustrated in U.S. Pat. No. 4,294,911 and in an article by J. R. Guild which appeared in *Res. Disc.*, 186, pages 575–576, (1979).

SUMMARY OF THE INVENTION

This invention involves the production of choline base that is essentially colorless and is resistant to discoloration over significant periods of time. Several techniques for obtaining the above described product are described below. The invention also involves a choline base product having an exceptional combination of low impurity level and resistance to discoloration that is exceptionally suitable for use in the electronics industry.

The process involves the use of an electrolytic cell having an anode compartment containing an anode and a cathode compartment containing a cathode, the anode and cathode compartments are separated by a cationic membrane capable of rejecting passage of essentially all halide ions from the anode compartment to the cathode compartment and also is capable of permitting passage of hydrated choline ions from the anode compartment to the cathode compartment. The process comprises feeding a solution of choline halide into the anode compartment; feeding a dilute aqueous solution of choline base into the said cathode compartment; establishing and maintaining a sufficient electrical potential between the anode and cathode to produce a flow of electrical current across the cell thereby causing halide ions to lose an electron at said anode, hydrated choline ions to migrate through said membrane from said anode compartment into said cathode compartment and to combine with hydroxide ions to form choline base that is essentially free of halide, and to dissociate water at the cathode to form hydrogen and hydroxide ions; and then removing an aqueous solution of the choline base from the cathode compartment. One technique for obtaining the product of the invention is to add a sulfite, such as ammonium sulfite, to the cathode compartment of the electrolytic cell in an amount sufficient to make the choline base produced by the process resistant to discoloration. A second aspect of making choline base solutions that are resistant to discoloration is through control of the choline base concentration. In general, it has been discovered that concentrations of about 10 wt % or less are much more resistant to discoloration than solutions containing greater amounts of choline base.

BRIEF DESCRIPTION OF THE DRAWING

The sole FIGURE is a schematic cross-sectional drawing of a typical electrolytic cell useful in performing the process of the inventions.

DETAILED DESCRIPTION OF THE INVENTION

A schematic cross-sectional representation of an electrolytic cell suitable for conducting the process of the invention is shown in the FIGURE. Using the conversion of choline chloride to choline base as a representative example, the cell functions to effect the overall reaction shown below:

$$2(HOCH_2CH_2)N\text{-}(CH_3)_3{}^+Cl^- + 2H_2O \rightarrow 2(HOCH_2CH_2)N\text{-}(CH_3)_3{}^+OH^- + H_2\uparrow + Cl_2\uparrow$$

An electrical potential is established and maintained by power source 10 between anode 11 and cathode 12 to produce a flow of current across cell 13 to convert chloride ions into chloride gas at anode 11 and water to dissociate into hydrogen gas and hydroxide ions at cathode 12. Chlorine gas and hydrogen gas pass off at the anode and cathode, and are collected and passed away at gas collection means 14 and 15 respectively. In addition, the current flow causes choline ions to migrate from anode compartment 16 through cationic membrane 17 into cathode compartment 18 where the choline and hydroxide ions combine to form a solution of choline base. This solution is removed from this compartment through removal means 19. Dilute choline chloride solution and/or dilute choline base may be periodically or continuously added, through feed means 20 and 21, respectively, to maintain an appropriate concentration in the respective compartments. Choline chloride solution is contained in anolyte tank 24. Such solution may be continuously or periodically circulated to and from anode compartment 16 with use of lines 26 and 27. Circulation is effected by pump 28. Line 27 serves to pass the chloride solution into anode compartment 26 while line 26 serves as an exit line for choline chloride solution and chlorine gas. Choline base solution is contained in catholyte tank 25. Such solution may be continuously or periodically circulated to and from cathode compartment 18 with use of lines 30 and 31. Circulation is effected by pump 29. Line 30 serves to pass the choline base solution into cathode compartment 18 while line 29 serves as an exit line for choline base solution and hydrogen gas. Spent solution may be removed from the anode compartment by removal means 22. Inert gas inlet 23, is provided to blanket the cathode compartment and catholyte tank. Typically nitrogen or other gases such as argon or other noble gases that are inert to choline base may be used.

The type of electrolytic cell that may be used in connection with the process of the invention is not limited. For example, such well known cells as the filter press or finger type may be utilized. Conventional cell materials that are compatible with the materials being treated are used in the construction of the cell.

The anode and cathode do not directly enter into the reaction and thus may be made from materials that do not react with the baths. While a variety of such materials may be used, ruthenized titanium anodes and nickel-plated titanium cathodes have been utilized successfully. Nickel functions as a catalyst for hydrogen evolution in basic solutions. Other suitable anode materials include but are not limited to platinized titanium. Other suitable cathode materials include but are not limited to glassy carbon, or stainless steel.

Suitable cationic membranes for the invention include fluorinated membranes conveying cation exchange groups such as perfluorosulfonic acid perfluorocarbon polymer membrane, which is sold under the trademark "NAFION" by E. I. DuPont de Nemours & Company, Wilmington, Del. It is specifically contemplated that NAFION 315, NAFION 390 and NAFION 425 membranes may be so utilized. Perfluorosulfonic acid perfluorohydrocarbon polymer membranes are believed to have the following structure:

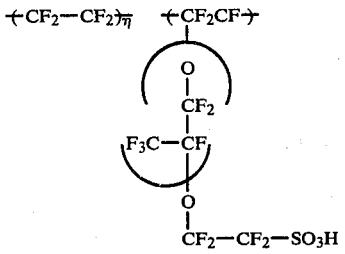

in which the concentration of exchange groups are described as about 1,100 to 1,500 g of dry membrane per equivalent of $SO_3^-$ exchange groups. Such cation exchange membranes may be also employed as having weak acid groups of carboxylic acid, phosphoric acid and the like, solely or in combination with sulfonic acid aforesaid. The membrane is further described in U.S. Pat. No. 4,240,883 in connection with its use in the electrolysis of an aqueous alkali metal chloride solution to produce aqueous alkali metal hydroxides.

It has been discovered that choline base solutions of various desired concentrations such as 20 wt % that are essentially free of undesirable impurities such as $F^-$, $Br^-$, $Cl^-$, $CO_3^=$, $Na^+$, $K^+$, and $Li^+$, and therefore of value in microcircuit fabrication processes, can be produced by practice of the process of the invention. In this connection it is advantageous to employ aqueous solutions of choline halide (e.g., ≦30 wt.%), containing low levels (e.g. ≦5 ppm) of alkali metal ion impurities in the feedstream.

Several techniques may be utilized in combination with the above described electrolytic technique to produce electronic quality choline base that contains ≦10000 ppm halide (Cl,Br, or I) and ≦15 ppm alkali metal (Li, Na, or K) and is resistant to discoloration. Preferred impurity limits are ≦4000 ppm halides and ≦10 ppm each of alkali metals. Use of any of the discoloration prevention techniques of the invention eliminates the necessity for treatment with decolorizing carbon and subsequent tedious filtration.

A first technique comprises introducing a sulfite into the cathode compartment of the electrolytic cell. It is speculated that the hydroxyethyl group in choline is oxidized to an aldehyde which polymerizes to a highly colored species, and that sulfites form adducts with these aldehydes, thereby preventing such undesirable discoloration. The amount of sulfite introduced into the cell should be an amount sufficient to reduce the tendency of the choline base produced by the process to darken in color. Typically the sulfite is included in amounts of 0.01 to 0.4 moles per mole of choline base. An optimum amount for the electrolytically produced solutions of the invention is believed to be on the order of 0.1 mole of sulfite per mole of choline base.

Sulfites useful in the practice of this invention include but are not limited to alkali metal sulfites, alkali metal bisulfites, alkali metal metabisulfites, and sulfites of nitrogen bases such as ammonium sulfite or various alkanolamine sulfites such as triethanolamine sulfite.

A second discoloration resistance technique involves control of the concentration of the choline base solution. It has been discovered that if the concentration of the aqueous solution is maintained at a maximum of about 10%, that significant discoloration can be prevented for periods of at least 8 months. Such time periods are sufficient to permit normal shipment and use of the choline base prior to the occurrence of discoloration.

Concentration control may be effected by controlling the concentration of the product produced in the electrolytic process or by promptly diluting such product. If dilution is utilized as the control technique, such dilution should be performed within about 4 hours of removal of the product from the cell.

The aqueous choline base solution of the invention is characterized by low impurity levels of halides and alkali metals as well as having excellent resistance to darkening or discoloration. These products may be stored for time periods of 8 months or more without significant discoloration. Halide impurities such as Cl, Br, and I are at levels of ≦10000 ppm and preferably ≦4000 ppm; and alkali metal impurities such as Na, K, and Li are maintained at levels ≦15 ppm and preferably at ≦10 ppm. The impurity levels are expressed with respect to contained choline base in the solution. This product is uniquely adapted for use in the electronics industry due to the impurity level and resistance to discoloration. Its preparation requires the combination of electrolytic processing for impurity control as well as subsequent discoloration treatment.

The advantages and practice of the invention are further illustrated by the following examples.

EXAMPLES 1-10

A 0.43 $Ft^2$ electrolytic cell is assembled with the NAFION membranes listed in Table I, a ruthenized titanium anode and a nickel-plated titanium cathode. For Example 1, a feedstream of choline chloride having a standard solution volume of 4.0 liters is circulated through the anolyte chamber, while a solution of choline base having a standard solution volume of 2.5 liters is employed as the circulating fluid in the catholyte chamber to provide electrical conductivity.

Upon application of an electrical current of about 80 amps, choline ions pass rapidly through the membranes along with six moles of water, one of which is converted by the cathode into hydrogen and hydroxyl ions.

Following operation of the cell for a period of time, choline base having the concentrations and impurity level shown in Table I is obtained. Additional information regarding Examples 1–10 is shown in Table II.

TABLE I

| EXAMPLE | NAFION MEMBRANE | PRODUCT CONCENTRATION (wt. %) | Cl (ppm) | $(CH)_2$*$CO_3$ (ppm) | Li (ppm) | Na (ppm) | K (ppm) | Fe (ppm) |
|---|---|---|---|---|---|---|---|---|
| 1 | 425 | 14.3 | 800 | 330 | ND | 18 | 0.2 | ND |
| 2 | 425 | 22.8 | 400 | 460 | ND | 9.0 | 0.2 | ND |
| 3 | 390 | 21.6 | 500 | 460 | ND | 5.25 | 0.03 | ND |
| 4 | 390 | 23.6 | 510 | 180 | ND | 0.6 | ND | ND |
| 5 | 390 | 22.8 | ND | 200 | ND | 1.55 | 0.05 | 0.10 |
| 6 | 390 | 22.0 | ND | ND | ND | 13.2 | 0.24 | 0.20 |
| 7 | 315 | 23.3 | ND | ND | ND | 12.1 | 0.32 | 0.06 |
| 8 | 315 | 23.4 | ND | ND | ND | 11.2 | 0.22 | 0.16 |
| 9 | 315 | 14.7 | ND | ND | 0.01 | 5.5 | 0.09 | 0.19 |
| 10 | 315 | 17.5 | ND | ND | 0.01 | 6.7 | 0.13 | 0.1 |

ND = Not Determined
*CH = choline

As shown in the Table the levels of the various impurities were quite low indicating that the electrolytic process is useful to control the incidence of such impurities.

TABLE II

| Example | Nafion Membrane | Start Cl | Conc. OH | Final Cl | Conc. OH | Remarks |
|---|---|---|---|---|---|---|
| 1 | 425 | 10% | 5% | 1.3% | 14.3% | Syntex Pharm. Gr. chloride |
| 2 | 425 | 25 | 10 | — | 22.8 | Aldrich chloride |
| 3 | 390 | 24 | 5 | 7.4 | 21.6 | Aldrich chloride |
| 4 | 390 | 25 | 10 | 10.6 | 23.6 | Starting OH from carbon treat/ filtered Ex. 2 |
| 5 | 390 | 25 | 10 | 11.3 | 22.8 | Same as Ex. 3 |
| 6 | 390 | 25 | 10 | 15.4 | 22.0 | Syntex Tech. Gr. chloride |
| 7 | 315 | 25 | 10 | 11.7 | 23.3 | Tech. Gr. Cl; OH from UN-TREATED Ex. 5 |
| 8 | 315 | 25 | 10 | 13.4 | 23.4 | OH from TREATED Ex. 5 |
| 9 | 315 | 14 | 7.5 | 0.6 | 14.7 | Both starting solutions treated (colorless) |
| 10 | 315 | 25 | 5.6 | 10.7 | 17.5 | $(NH_4)_2SO_3$ in starting OH |

EXAMPLE 11

With respect to discoloration, Example 9 was made with use of starting solutions that are previously decolorized to a water-white color with use of decolorizing carbon and filtration. Despite such pretreatment, a 14.7% product is slightly colored. Example 10 utilized a 70% concentration of choline chloride which is yellow in color, diluted to 25%. A starting feedstream of a 14.7% solution of decolorized choline base was used in the catholyte compartment. Ammonium sulfite was added to the choline base in an amount sufficient to prevent discoloration of an anticipated product concentration of about 20%. The added amount of ammonium sulfite was 71 gms, resulting in a starting hydroxide solution composition of 5.6 wt% choline base and 2.8 wt.% ammonium sulfite. This would provide 0.1 mole sulfite per mole of choline base at the expected 20% concentration of product. The 17.5% product was water-white in color and remained such color.

EXAMPLES 12–15

During the above mentioned runs, it was observed that color formation occurred only during late portions of the runs when the choline base concentration was increased. These results indicated that discoloration was concentration sensitive. Samples of decolorized choline base were diluted with deionized water to concentrations of 5, 10, 15, and 20% and retained in capped polyethylene bottles under a nitrogen atmosphere. The 20% sample indicated a faint yellow tint in one day and was amber colored in two weeks. The 15% sample acquired a faint yellow tint in 5 days. The 5 and 10% samples remained water-white for over 6 months. This indicates that choline base shipped at concentration of about a maximum of 10% will not discolor prior to use during normal contemplated commercial usage.

I claim:

1. A process for producing a water-white colored aqueous solution of choline base that is resistant to discoloration in an electrolytic cell having an anode compartment containing an anode and a cathode compartment containing a cathode, said anode and cathode compartments being separated by a cationic membrane capable of rejecting passage of essentially all halide ions from said anode compartment to the cathode compartment and capable of permitting passage of hydrated choline ions from said anode compartment to said cathode compartment, comprising: feeding a solution of choline halide into said anode compartment; feeding dilute aqueous choline base into said cathode compartment; adding a sulfite to a chamber of said electrolytic cell in an amount sufficient to make the choline base produced by the process resistant to discoloration; establishing and maintaining a sufficient electrical potential between said anode and cathode to produce a flow of electrical current across said cell thereby causing halide ions to lose an electron at said anode, hyrated choline ions to migrate through said membrane from said anode compartment into said cathode compartment and to combine with hydroxide ions to form choline base that is essentially free of halide, and to dissociate water at the cathode to form hydrogen and hydroxide ions; and removing an aqueous solution of said choline base from said cathode compartment that contains impurities of $\leqq 1000$ ppm halides and carbonates and $\leqq 15$ ppm alkali metals.

2. The process of claim 1, wherein: said sulfite is a member selected from the group consisting of alkali metal sulfides, alkali metal bisulfites, alkali metal metabisulfites, and sulfites of nitrogen bases.

3. The process of claim 2, wherein: said sulfite is ammonium sulfite.

4. The process of claim 1, wherein: said sulfite is added to the cathode chamber of said electrolytic cell.

5. The process of claim 1, wherein: said sulfite is added in an amount from about 0.01 to 0.4 moles per mole of choline base removed from said cathode compartment.

6. The process of claim 1, wherein: said choline halide is choline chloride.

7. A process for producing a water-white colored aqueous solution of choline base comprising a maximum of 10% by weight of choline base that is resistant to discoloration in an electrolytic cell having an anode compartment containing an anode and a cathode compartment containing a cathode, said anode and cathode compartments being separated by a cationic membrane capable of rejecting passage of essentially all halide ions from said anode compartment to the cathode compartment and capable of permitting passage of hydrated choline ions from said anode compartment to said cathode compartment, comprising: feeding a solution of choline halide into said anode compartment; feeding dilute aqueous choline base into said cathode compartment; establishing and maintaining a sufficient electrical potential between said anode and cathode to produce a flow of electrical current across said cell thereby causing halide ions to lose an electron at said anode, hydrated choline ions to migrate through said membrane from said anode compartment into said cathode compartment and to combine with hydroxide ions to form choline base that is essentially free of halide, and to dissociate water at the cathode to form hydrogen and hydroxide ions; and removing an aqueous solution of choline base from said cathode compartment to provide a composition that is resistant to discoloration and contains impurities of $\leqq$10000 ppm halides and carbonates and $\leqq$15 ppm alkali metals.

8. The process of claim 7, wherein: said solution of choline base removed from said cathode compartment contains a maximum of 10% by weight of choline base whereby said solution is resistant to discoloration.

9. The process of claim 7, wherein: said solution of choline base removed from said cathode compartment contains an amount of choline base greater than 10% by weight and said solution is diluted so as to reduce the choline base concentration to less than 10% by weight within about 4 hours whereby said solution is rendered resistant to discoloration.

10. The process of claims 1 or 7, wherein: said choline base contains a maximum of 10000 ppm halide and a maximum of 15 ppm alkali metal.

11. The product produced by the process of claim 1 or 8.

* * * * *